United States Patent [19]

Hartl

[11] 4,053,802

[45] Oct. 11, 1977

[54] HIGH-VOLTAGE VACUUM TUBE, PARTICULARLY AN X-RAY TUBE

[75] Inventor: Walter Hartl, Hamburg, Germany

[73] Assignee: U.S. Philips Corporation, New York, N.Y.

[21] Appl. No.: 656,618

[22] Filed: Feb. 9, 1975

[30] Foreign Application Priority Data

Feb. 18, 1975 Germany ..... 2506841

[51] Int. Cl.[2] ..... H01J 35/00

[52] U.S. Cl. ..... 313/55; 313/256; 313/289

[58] Field of Search ..... 313/55, 58, 61 R, 61 S, 313/256, 289, 313

[56] References Cited

U.S. PATENT DOCUMENTS 3,911,306 10/1975 Peter ..... 313/58

*Primary Examiner*—Rulolph V. Rolinec
*Assistant Examiner*—Darwin R. Hostetter
*Attorney, Agent, or Firm*—Frank R. Trifari

[57] ABSTRACT

A high-voltage, high vacuum electron discharge tube particularly an X-ray tube, having a metal envelope and an anode insulatingly mounted within the envelope. To avoid the deleterious effects of charge formed on the insulator surface, the insulator is formed with a recess of larger size than the anode diameter and the anode is secured to the insulator by mounting it at the region of the bottom of the recess.

4 Claims, 2 Drawing Figures

HIGH-VOLTAGE VACUUM TUBE, PARTICULARLY AN X-RAY TUBE

The invention relates to a high-voltage vacuum tube, comprising a tube envelope which accommodates a cathode and an insulator which supports the anode and which is connected to a metal portion of the tube which carries a high negative voltage with respect to the anode during operation.

A high-voltage tube of this kind is known, for example, from German Patent No. 2,103,151. In the X-ray tube described therein, an anode and a cathode are each connected to a conical insulator which projects into a metal envelope, the anode and the cathode carrying a high positive and negative voltage, respectively, with respect to the metal envelope during operation. It has been found in practice that X-ray tubes of this kind are susceptible to breakdown and that they have a comparatively short service life. A thorough investigation has revealed that this phenomenon is caused by discharges on the insulator on which the anode is mounted. Not only do these discharges cause disturbances, but also gas is released thereby from the insulator which, because the getters in the X-ray tube cannot bind a indefinitely large quantity of gas, causes a premature breakdown of the X-ray tube after a comparatively short service life. Breakdown of the said relevant insulator also occurs occasionally.

The object of the invention is to provide a high-voltage vacuum tube of the kind set forth in which the described drawbacks are substantially mitigated. To this end, a high-voltage vacuum tube in accordance with the invention is characterized in that the insulator has a recess, a surface of which is open to the interior of the tube, the anode extending towards the cathode from the end of the recess remote from the cathode. Because, in accordance with the invention, the insulator on which the anode is mounted comprises a cavity, the risk of discharges on the insulator is substantially reduced. In a preferred embodiment of the invention, the cavity has the shape of a truncated cone. The cavity in the insulator may also have a different shape, as long as the shape is such that the mounting of the anode on the insulator leads to at least a substantial part of the insulator surface assuming an electrical potential, in the operating condition of the high-voltage vacuum tube, which accelerates free electrons from the insulator towards the anode.

The invention will be described in detail hereinafter with reference to the drawing which shows an embodiment of the invention.

Figure 1:
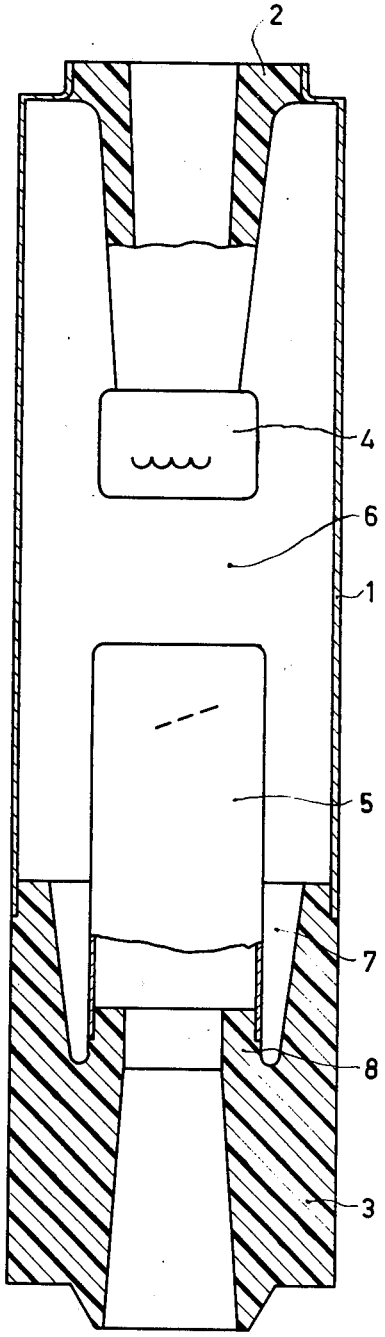
FIG. 1 shows an X-ray tube in accordance with the invention.

FIG. 1 shows an X-ray tube which comprises a cylindrical metal envelope 1. The metal envelope is closed at both ends by rotationally-symmetrical insulators 2 and 3 which are concentrically arranged with respect to the metal envelope 1 and which are preferably made of aluminium oxide ceramic or another suitable insulating material. The insulators 2 and 3 support a cathode 4 and an anode 5, respectively, which are arranged in the inner space 6 enclosed by the metal envelope 1. The cathode is at a high negative and the anode at a high positive potential with respect to the metal envelope 1 during operation. On their external sides both insulators comprise a recess to accommodate a high-voltage connector.

The insulator 2 on the side of the cathode is shaped in known manner (see, for example, German Patent No. 2,103,151) as a truncated cone which projects into the metal envelope from the area of contact with this envelope. The insulator 3 on which the anode 5 is mounted, however, comprises a cavity 7 which is open on the side adjoining the inner space 6, i.e., facing the cathode. This cavity is shaped, for example, as a truncated cone the diameter of which becomes progressively smaller away from the area of contact with the metal envelope and from the cathode. Near the end of the cavity which is remote from the cathode 4, the insulator comprises a shoulder 8 which faces the cathode and which is partly enclosed by the anode 5 which has the shape of a sleeve at this area. A vacuum-tight connection exists between the anode and the shoulder 8. The insulator 3 can be metallized on the outside, so that a protective cap can be dispensed with.

The operation of the tube in accordance with the invention is as follows. In the operating condition, i.e., with high voltages on the anode and the cathode, there is an electric field at the surface of the insulator 3 which faces the interior 6 of the X-ray tube, the said electrical field accelerating an electron, incident on the insulator or released by an incident scattered electron, from the insulator towards the anode. It is thus impossible for a single electron to cause a disturbance. If the insulator 3 on the anode side were shaped, for example, like the insulator on the cathode side, i.e., as a truncated cone projecting into the tube interior, an electron incident on the insulator (for example, released from the metal envelope) would also be accelerated towards the anode, but it would then move along the insulator surface because it would not be subjected to encounter an electrical force directed away from the insulator surface. After completing a given path length, an electron of this kind would have enough energy to release further electrons, which in turn would release further electrons, so that an electron avalanche from the insulator surface to the anode could arise which could cause a substantial disturbance, and in certain circumstances the release of gas from the insulator and even insulator breakdown.

The effect of the invention is further enhanced by the fact that the probability of the insulator surface being struck by an electron is smaller than in known X-ray tubes comprising an anode insulator which projects into the tube interior, because electrons, for example released by field emission from the surface of the metal envelope, cannot even reach the insulator but are directly accelerated towards the anode.

The disturbances caused by the presence of an anode insulator which projects into the tube interior will not occur at the insulator 2 on the cathode side, because electrons reaching or being released from the insulator surface will move directly to the metal envelope through the vacuum, and will not move along the insulator surface.

Near the insulator 3 on the anode side in the drawing, particularly at the area of the shoulder 8 which is not enclosed by the anode sleeve and also at the area of contact with the metal envelope, the electric field is not directed so that an electron is moved thereby away from the insulator surface and towards the anode. At these areas, therefore, electrons can move to the anode along the insulator surface. However, there is no risk of an electron avalanche, because the potential changes comparatively little along the comparatively small distance traversed, so that no electron multiplication occurs.

Figure 2:
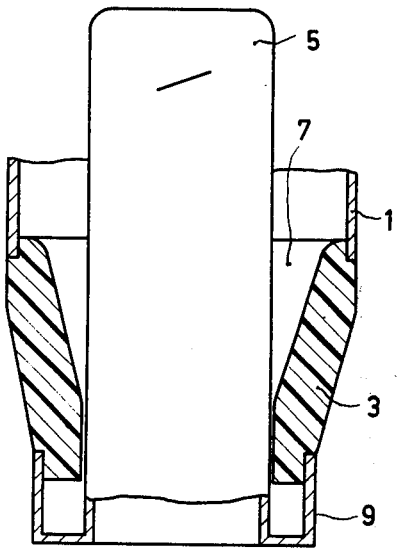
FIG. 2 shows an alternative form for a special embodiment of the insulator supporting the anode.

For the insulator on the anode side shown in FIG. 1 where the insulator at the same time serves to accommodate a high-voltage connector, a comparatively large quantity of insulating material is required. Consequently, the cost is comparatively high, particularly in the case of tubes for higher voltages in which the insulator dismensions are larger. FIG. 2 shows an arrangement in accordance with the invention which requires only a comparatively small quantity of insulating material.

This Figure does not show the cathode side of the X-ray tube. Parts of the X-ray tube which have the same function as in FIG. 1 are denoted by the same references The insulator 3 on the anode side is shaped as a hollow truncated cone the diameter of which becomes smaller away from the tube interior and towards the anode. The anode 5 projects into the metal envelope through the narrower end of the truncated cone. The anode 5 is connected to the outer surface of the insulator 3 via a collar 9, for example by soldering.

The high-voltage connection can be realized by means of an adapter which is not shown and which comprises — at its end which is remote from the X-ray tube — a recess for accommodating a high-voltage connector (like the insulator in FIG. 1); at its end adjacent the X-ray tube, the adapter comprises a recess adapted to the outer dimensions of the X-ray tube. This adapter is pressed, with insertion of, for example, an intermediate insulating rubber grommet, against the X-ray tube or the insulator 3. The adapter is also made of an insulating material; however, use can now be made of an insulating material which is not suitable for vacuum applications but which, for example, can be manufactured substantially more easily than the material of the insulator 3 (for example, aluminium oxide ceramic) and which is substantially cheaper, for example, the insulating material which is commercially available by the name of Araldite. As a result, the X-ray tube as a whole will be cheaper.

The invention can also be used in X-ray tubes comprising a rotary anode. An X-ray tube of this kind comprises, for example, (as has already been disclosed in — the previous — German Patent Application P 24 55 974) an earthed rotor and an anode which is at a high positive voltage, the rotor and the anode being interconnected via an insulator. The rotor then constitutes the metal portion of the tube in the sense of the principal Claim. The invention can also be used in other high-voltage discharge tubes such as, for example, neutron tubes.

What is claimed is:

1. A high-voltage vacuum tube comprising an envelope having a metal portion and within the envelope a cathode, an anode, and an insulator member, said metal portion in the operation of said tube being at a high negative voltage relative to said anode, said insulator being provided with a recess open to the interior of the tube and spacedly surrounding the anode, said anode being mounted within said recess and being connected to the insulator member at the bottom portion of the recess.

2. A high-voltage vacuum tube as claimed in claim 1 wherein the insulator recess is in the form of a truncated cone the diameter of which increases in the direction of the cathode.

3. A high-voltage vacuum tube as claimed in claim 1 wherein the insulator extends through the wall of the envelope and the exterior portion thereof comprises a recess for a high-voltage connector.

4. A high-voltage vacuum tube as claimed in claim 1 wherein the cathode operates at high negative voltage with respect to the metal portion of the envelope and the cathode is supported by an insulator in the shape of a truncated cone which insulator projects into the envelope and is mechanically connected thereto.

* * * * *

UNITED STATES PATENT AND TRADEMARK OFFICE

CERTIFICATE OF CORRECTION

PATENT NO. : 4,053,802

DATED : October 11, 1977

INVENTOR(S) : WALTER HARTL

It is certified that error appears in the above-identified patent and that said Letters Patent are hereby corrected as shown below:

In the Title Page, Section [22], "Feb. 9, 1975" should be

--Feb. 9, 1976--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*